US009663893B2

(12) United States Patent
Malheiros

(10) Patent No.: US 9,663,893 B2
(45) Date of Patent: May 30, 2017

(54) LAUNDRY TREATING APPLIANCE DISPENSER

(71) Applicant: Whirlpool Corporation, Benton Harbor, MI (US)

(72) Inventor: George W. Malheiros, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 392 days.

(21) Appl. No.: 14/221,733

(22) Filed: Mar. 21, 2014

(65) Prior Publication Data

US 2015/0267340 A1 Sep. 24, 2015

(51) Int. Cl.

| | |
|---|---|
| ***D06F 39/02*** | (2006.01) |
| *D06F 33/02* | (2006.01) |
| *D06F 37/26* | (2006.01) |

(52) U.S. Cl.

CPC ..... *D06F 39/028* (2013.01); *D06F 33/02* (2013.01); *D06F 37/266* (2013.01); *D06F 2202/02* (2013.01); *D06F 2202/04* (2013.01); *D06F 2202/10* (2013.01); *D06F 2202/12* (2013.01); *D06F 2204/08* (2013.01)

(58) Field of Classification Search

CPC ..... D06F 39/028

See application file for complete search history.

(56) References Cited

U.S. PATENT DOCUMENTS

| | | | |
|---|---|---|---|
| 5,548,978 | A | 8/1996 | Bongini et al. |
| 5,934,109 | A | 8/1999 | Kiefer et al. |
| 7,421,867 | B2 | 9/2008 | Bongini |
| 2007/0022788 | A1 | 2/2007 | Choi et al. |
| 2007/0240456 | A1 | 10/2007 | Byun et al. |

FOREIGN PATENT DOCUMENTS

| | | | |
|---|---|---|---|
| DE | 102006003416 | A1 | 7/2007 |
| EP | 2013400 | B1 | 3/2012 |

OTHER PUBLICATIONS

German Search Report for Counterpart DE102015100809.2, dated Oct. 29, 2015.

*Primary Examiner* — Jason Ko

(57) ABSTRACT

A laundry treating appliance may comprise a tub at least partially defining a treating chamber and having an opening at least partially aligned with an opening in the appliance front panel, thus providing access to the treating chamber through the front panel opening and the tub opening. A bellows may connect the front panel and the tub at their respective openings, and a treating chemistry dispenser may be located on the bellows.

13 Claims, 7 Drawing Sheets

LAUNDRY TREATING APPLIANCE DISPENSER

BACKGROUND

Laundry treating appliances, such as a clothes washer, typically use one or more treating chemistries, such as detergent, fabric softener, bleach, and oxidizers, to treat a load of laundry. The treating chemistry may be supplied by a user directly into a treating chamber of the laundry treating appliance or into a dispenser that holds the treating chemistry and supplies the treating chemistry into the treating chamber at a desired time during a treating cycle of operation. Treating chemistries for use in household appliances are commonly provided in a liquid or powder form, and a user pours the liquid or powder into the treating chamber or into the dispenser to fill the dispenser. Recently, treating chemistries have become available in other forms, including a pod having a dissolvable packaging that contains the treating chemistry. Pods provide the user the convenience of placing a predetermined, consistent amount of treating chemistry directly into the treating chamber, but sometimes the pod can become lodged in an undesirable location that prevents complete dissolution of the packaging.

SUMMARY

A laundry treating appliance according to one embodiment for treating laundry according to an automatic cycle of operation may comprise a chassis having a front panel with an opening, a tub located within the chassis and at least partially defining a treating chamber, the tub having an opening at least partially aligned with the front panel opening providing access to the treating chamber through the front panel opening and the tub opening, a bellows connecting the front panel and the tub at their respective openings, a treating chemistry dispenser located on the bellows and including a receptacle holding a treating chemistry, and a liquid supply system including a liquid conduit with an outlet positioned to supply liquid into the receptacle whereby the liquid from the liquid conduit flows through the receptacle dispensing the treating chemistry from the receptacle into the treating chamber.

DESCRIPTION OF EMBODIMENTS OF THE INVENTION

Figure 1:
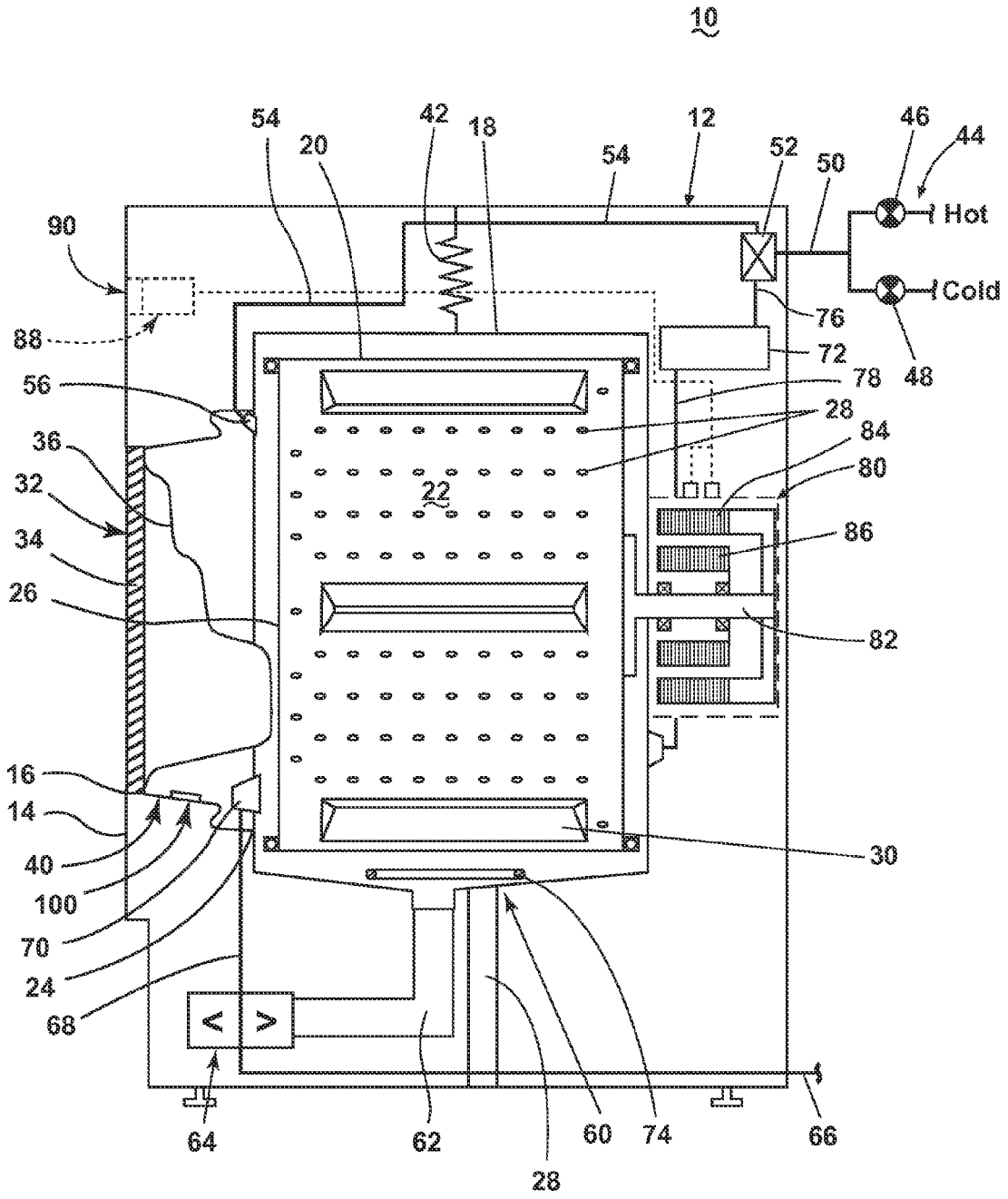
FIG. 1 is a schematic view of a laundry treating appliance in the form of a washing machine according to a first embodiment of the invention.

FIG. 1 is a schematic view of a laundry treating appliance according to a first embodiment of the invention. The laundry treating appliance may be any appliance which performs a cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine.

The laundry treating appliance of FIG. 1 is illustrated as a washing machine 10, which may include a structural support system having a cabinet 12 which defines a housing within which a laundry holding system resides. The cabinet 12 may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention. The cabinet 12 may include a front panel 14 that covers the front of the cabinet 12 and includes an opening 16 to allow a user to access the interior of the washing machine 10.

The laundry holding system comprises a tub 18 supported within the cabinet 12 by a suitable suspension system and a drum 20 provided within the tub 18, the drum 20 defining at least a portion of a laundry treating chamber 22. The tub 18 and the drum 20 may have aligned openings 24, 26 that also align with the front panel opening 16 to provide user access to the laundry treating chamber 22 through the front panel opening 16, the tub opening 24, and the drum opening 26. The drum 20 may include a plurality of perforations 28 such that liquid may flow between the tub 18 and the drum 20 through the perforations 28. A plurality of baffles 30 may be disposed on an inner surface of the drum 20 to lift the laundry load received in the treating chamber 22 while the drum 20 rotates. It is also within the scope of the invention for the laundry holding system to comprise only a tub with the tub defining the laundry treating chamber.

The laundry holding system may further include a door 32 movably mounted to the cabinet 12 to selectively close at least the front panel opening 16 and, thereby, selectively provide access to the treating chamber 22. A window 34 may be provided on the door 32 to allow a user to view the laundry treating chamber 22 through the door 32 when the door 32 is closed, and, optionally, a projection 36, which may be at least partially translucent, may extend inwardly towards the treating chamber 22 from the inner surface of the window 34. The projection 36, if included, may have any suitable configuration, and the projection 36 shown in the figures is provided for illustrative purposes only. A bellows 40 may couple the front panel opening 16 of the cabinet 12 and the opening 24 of the tub 18, with the door 32 sealing against the bellows 40 when the door 32 closes the tub 18. The bellows 40 will be discussed in more detail below.

The washing machine 10 may further include a suspension system 42 for dynamically suspending the laundry holding system within the structural support system.

The washing machine 10 may further include a liquid supply system for supplying water or other liquid to the washing machine 10 for use in treating laundry during a cycle of operation. The liquid supply system may include a source of water, such as a household water supply 44, which may include separate valves 46 and 48 for controlling the flow of hot and cold water, respectively. Water may be supplied through an inlet conduit 50 directly to the tub 18 by controlling a diverter mechanism 52. The diverter mechanism 52 may be a diverter valve having two outlets such that the diverter mechanism 52 may selectively direct a flow of liquid to one or both of two flow paths. Water from the household water supply 44 may flow through the inlet conduit 50 to the diverter mechanism 52 that may direct the flow of liquid to a supply conduit 54. The supply conduit 54 may supply the water into the tub 18 and may be provided with a spray nozzle 56 configured to spray the flow of liquid into the tub 18. In this manner, water from the household water supply 44 may be supplied directly to the tub 18. The spray nozzle 56 may be located on the bellows 40.

The washing machine 10 may also include a recirculation and drain system for recirculating liquid within the laundry holding system and draining liquid from the washing machine 10. Liquid supplied to the tub 18 may flow by gravity to a sump 60 formed in part by a lower portion of the tub 18. The sump 60 may also be formed by a sump conduit 62 that may fluidly couple the lower portion of the tub 18 to a pump 64. The pump 64 may direct liquid to a drain conduit 66, which may drain the liquid from the washing machine 10, or to a recirculation conduit 68, which may terminate at a recirculation inlet 70. The recirculation inlet 70 may direct the liquid from the recirculation conduit 68 into the drum 20. The recirculation inlet 70 may introduce the liquid into the drum 20 in any suitable manner, such as by spraying, dripping, or providing a steady flow of liquid. In this manner, liquid provided to the tub 18 may be recirculated into the treating chamber 22 for treating the laundry within. The recirculation inlet 70 may be located on the bellows 40.

The liquid supply and/or recirculation and drain system may be provided with a heating system which may include one or more devices for heating laundry and/or liquid supplied to the tub 18, such as a steam generator 72 and/or a sump heater 74. Liquid from the household water supply 44 may be provided to the steam generator 72 through the inlet conduit 50 by controlling the diverter mechanism 52 to direct the flow of liquid to a steam supply conduit 76. Steam generated by the steam generator 72 may be supplied to the tub 18 through a steam outlet conduit 78. The steam generator 72 may be any suitable type of steam generator such as a flow through steam generator or a tank-type steam generator. Alternatively, the sump heater 74 may be used to generate steam in place of or in addition to the steam generator 72. In addition or alternatively to generating steam, the steam generator 72 and/or sump heater 74 may be used to heat the laundry and/or liquid within the tub 18 as part of a cycle of operation.

Additionally, the liquid supply and recirculation and drain system may differ from the configuration shown in FIG. 1, such as by inclusion of other valves, conduits, sensors, such as water level sensors and temperature sensors, and the like, to control the flow of liquid through the washing machine 10.

The washing machine 10 also includes a drive system for rotating the drum 20 within the tub 18. The drive system may include a motor 80, which may be directly coupled with the drum 20 through a drive shaft 82 to rotate the drum 20 about a rotational axis during a cycle of operation. The motor 80 may be a brushless permanent magnet (BPM) motor having a stator 84 and a rotor 86. Alternately, the motor 80 may be coupled to the drum 20 through a belt and a drive shaft to rotate the drum 20, as is known in the art. Other motors, such as an induction motor or a permanent split capacitor (PSC) motor, may also be used. The motor 80 may rotate the drum 20 at various speeds in either rotational direction.

The washing machine 10 also includes a control system for controlling the operation of the washing machine 10 to implement one or more cycles of operation. The control system may include a controller 88 located within the cabinet 12 and a user interface 90 that is operably coupled with the controller 88. The user interface 90 may include one or more knobs, dials, switches, displays, touch screens and the like for communicating with the user, such as to receive input and provide output. The user may enter different types of information including, without limitation, cycle selection and cycle parameters, such as cycle options.

The controller 88 may include the machine controller and any additional controllers provided for controlling any of the components of the washing machine 10. For example, the controller 88 may include the machine controller and a motor controller. Many known types of controllers may be used for the controller 88. The specific type of controller is not germane to the invention. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

Figure 2:
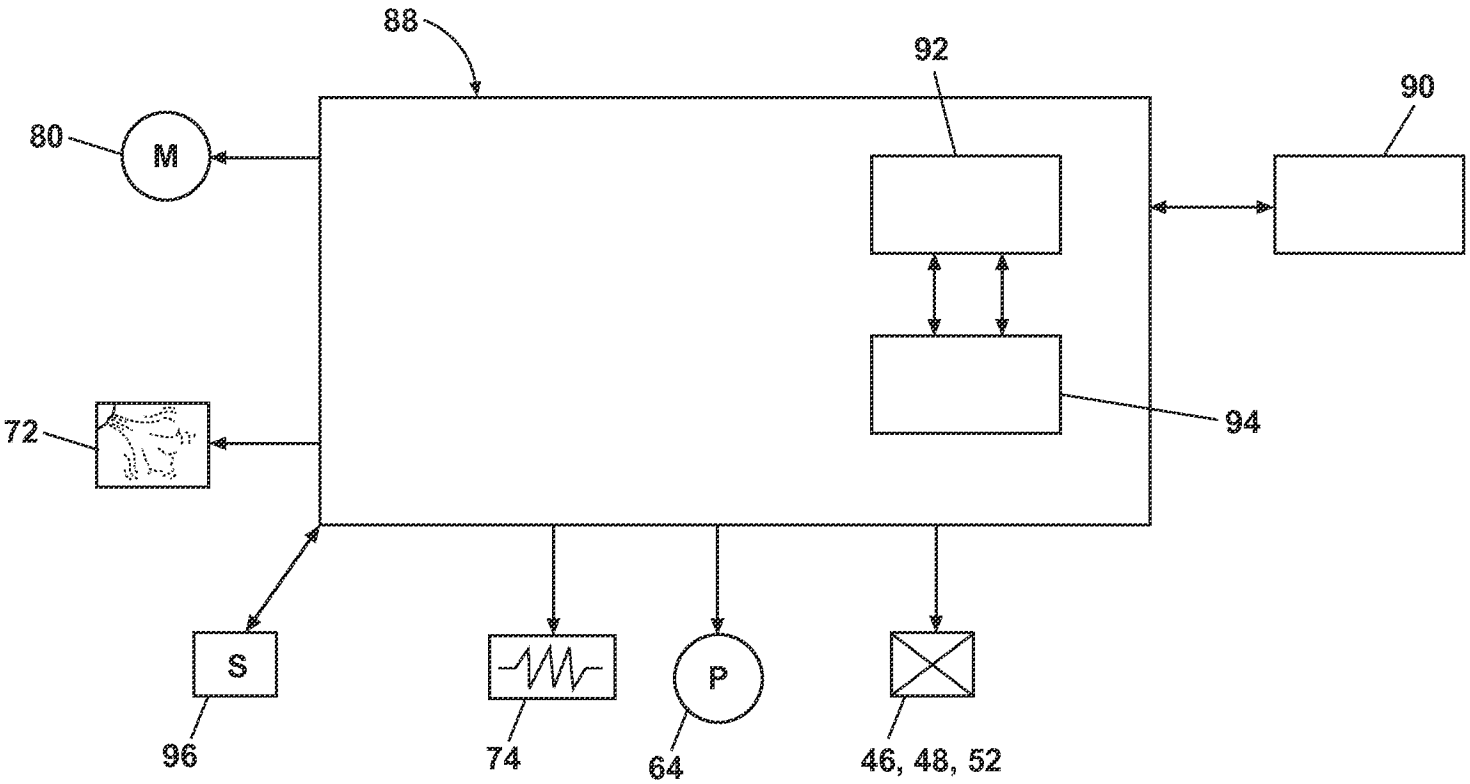
FIG. 2 is a schematic of a control system of the laundry treating appliance of FIG. 1 according to the first embodiment of the invention.

As illustrated schematically in FIG. 2, the controller 88 may be provided with a memory 92 and a central processing unit (CPU) 94. The memory 92 may be used for storing the control software that is executed by the CPU 94 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 92 may also be used to store information, such as a database or table, and to store data received from one or more components of the washing machine 10 that may be communicably coupled with the controller 88. The database or table may be used to store the various operating parameters for the one or more cycles of operation, including factory default values for the operating parameters and any adjustments to them by the control system or by user input.

The controller 88 may be operably coupled with one or more components of the washing machine 10 for communicating with and controlling the operation of the component to complete a cycle of operation. For example, the controller 88 may be operably coupled with the motor 80, the pump 64, the steam generator 72, and the sump heater 74 to control the operation of these and other components to implement one or more of the cycles of operation. The controller may also be operably coupled with the valves 46, 48 and the diverter mechanism 52 to control flow of fluid into and within the washing machine 10.

The controller 88 may also be coupled with one or more sensors 96 provided in one or more of the systems of the washing machine 10 to receive input from the sensors, which are known in the art and not shown for simplicity. Non-limiting examples of the sensors 96 that may be communicably coupled with the controller 88 include: a treating chamber temperature sensor, a moisture sensor, a weight sensor, a chemical sensor, a position sensor and a motor torque sensor, which may be used to determine a variety of system and laundry characteristics, such as laundry load inertia or mass.

The washing machine 10 may further include a dispensing system for dispensing treating chemistry to the treating chamber 22 for use in treating the laundry according to a cycle of operation. Referring now to the FIG. 3 perspective view of the front panel 14 and bellows 40 of the washing machine 10, the dispensing system may include a dispenser 100 located on the bellows 40, such as by being mounted to the bellows 40 or integrally formed with the bellows 40. As best seen in FIG. 4, which is a sectional view taken along line IV-IV of FIG. 3, the exemplary bellows 40 of the present embodiment may include a generally circular inner ring 102 that couples with the front panel 14 and a generally circular outer ring 104 that mounts to the tub 18. A corrugated portion 106 may join the inner and outer rings 102, 104 at their inner and outer ends, respectively. While the dispenser 100 may be located on any suitable portion of the bellows 40, in the present embodiment, the dispenser 100 may be located on the inner ring 102 of the bellows 40.

The dispenser 100 may be located downstream of the spray nozzle 56 that supplies liquid into the treating chamber 22 such that the liquid flows from the spray nozzle 56 and passes through the dispenser 100 to aid in dispensing the treating chemistry. As an example, the spray nozzle 56 may be located on an upper half of the bellows 40, while the dispenser 100 is located on a lower half of the bellows 40. Even more specifically, the spray nozzle 56 may be located in an upper quadrant of the bellows 40, and the dispenser 100 may be located on a lower quadrant of the bellows 40 below the spray nozzle 56. Other configurations of the relative positioning of the spray nozzle 56 and the dispenser 100 are contemplated, and, alternatively, the liquid supply system may include an additional liquid supply conduit dedicated to providing liquid to the dispenser 100, as will be discussed further below.

The dispenser 100 may have any suitable form for holding the treating chemistry and supplying the treating chemistry into the treating chamber 22. An exemplary dispenser 100 is illustrated in the schematic sectional view of the dispenser 100 and the bellows 40 in FIG. 5. The dispenser 100 may include a treating chemistry receptacle 110 that holds the treating chemistry, and the receptacle 110 may be formed by a curved side wall 112 that joins with the bellows 40 at its sides and is closed at its lower end by a bottom wall 114 that supports the treating chemistry. The upper ends of the receptacle 110 may form an open top 116 that provides access into the receptacle 110. The open top 116 also acts as an inlet for the receptacle 110, while one or more outlet openings 118 may be formed in the bottom wall 114. The outlet openings 118 have any suitable shape, such as a plurality of separate and spaced apertures, slits, apertures formed by a grate, and the like, as long as the outlet openings are sufficiently large for the dispensing of the treating chemistry therethrough.

Regardless of form, the treating chemistry receptacle 110 may be configured to hold a supply of treating chemistry. Treating chemistries may be provided in the receptacle 110 in any desirable form, such as a single charge, multiple charges (also known as bulk supply), or both. The treating chemistry may be in the form of, for example, a compressed block of powder, loose powder, liquid, gels, and the like. Further, the treating chemistry may be in the form of a pod or pouch having dissolvable packaging that contains the treating chemistry, which may itself have any suitable form, including the aforementioned powders, gels, and liquids. The pod may hold a single charge or multiple charges of the treating chemistry. When the treating chemistry is in the form of a pod or block, the user may simply place the pod or block into the treating receptacle 110. The remaining description of the dispensing system will be described as being used with treating chemistry in the form of a pod, with it being understood that the dispenser 100 is not limited for use with only pods. Non-limiting examples of treating chemistries that may be dispensed by the dispensing system during a cycle of operation include one or more of the following: detergent, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, color fidelity agents, and combinations thereof.

Figure 3:
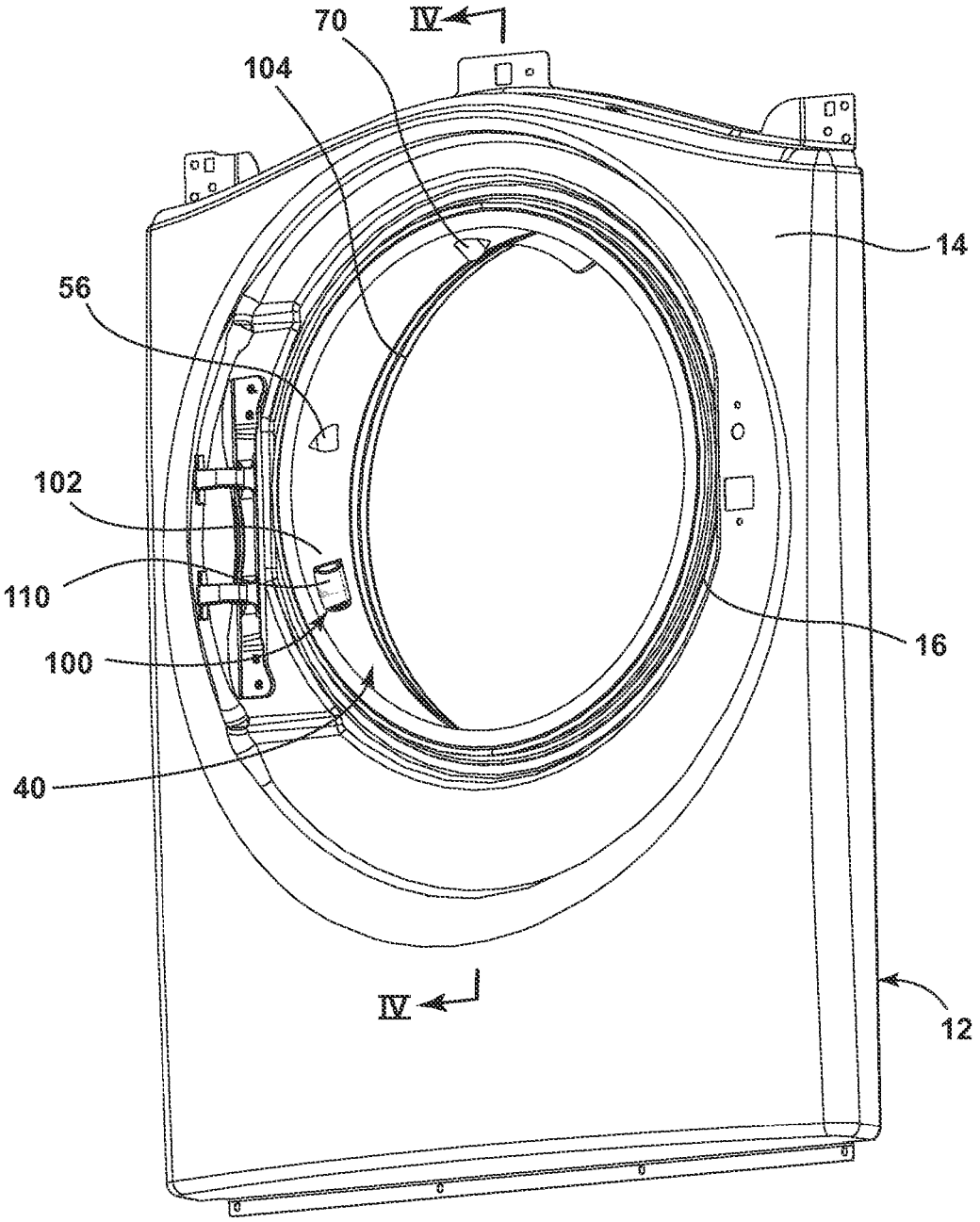
FIG. 3 is a perspective view of a front panel, a bellows, and a treating chemistry dispenser located on the bellows from the washing machine of FIG. 1.
Figure 4:
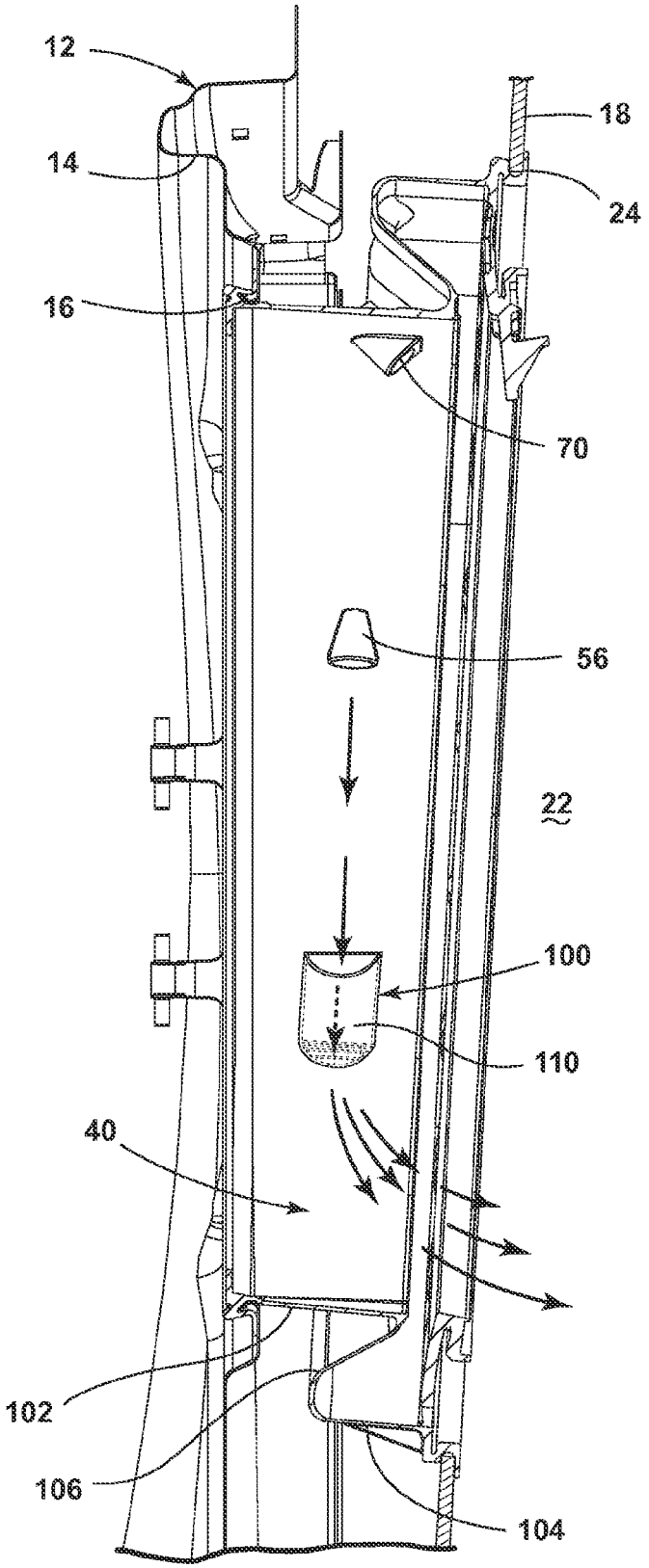
FIG. 4 is a sectional view taken along line IV-IV of FIG. 3.
Figure 5:
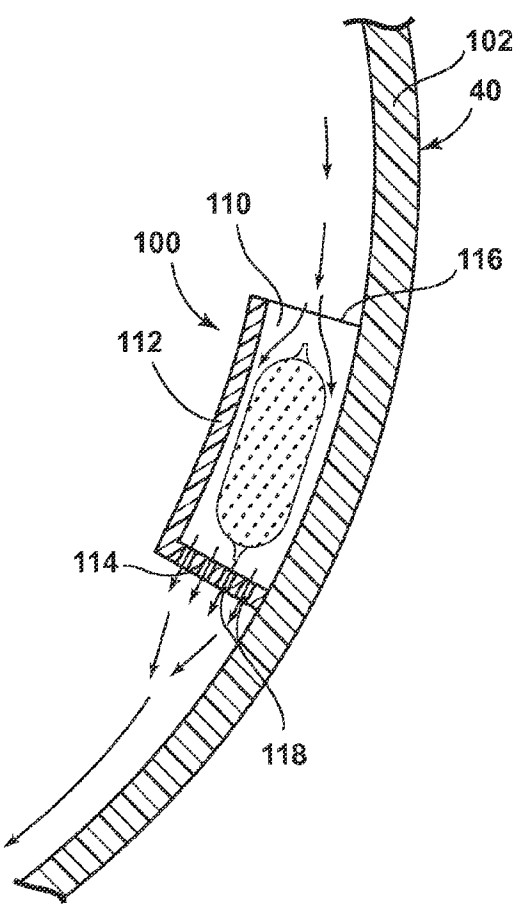
FIG. 5 is a schematic sectional view of the treating chemistry dispenser of FIG. 3 according to one embodiment.

A description of an exemplary method of operating the washing machine 10 with the dispensing system shown in FIGS. 3-5 follows. The method may proceed in any suitable manner, including any suitable order, may include additional steps not detailed herein, and need not include every step described below. The method may be adapted as needed to accommodate the particular structure, such as a particular liquid supply system, of the washing machine 10. The exemplary method begins with a user opening the door 32 (FIG. 1) to obtain access to the interior of the washing machine 10. The user puts the laundry in the treating chamber 22 through the front panel opening 16, past the bellows 40, and through the tub and drum openings 24, 26. The user may then place a pod of treating chemistry into the dispenser 100 on the bellows 40, such as by sliding the pod into the receptacle 110 through the open top 116 (FIG. 5). The user then closes the door 32 and instructs the controller 88 to begin a selected cycle of operation via the user interface 90 (FIG. 1). As shown in FIG. 4, at some point during the selected cycle of operation, liquid is supplied through the spray nozzle 56 and flows downward along the bellows 40 into the dispenser 100. The general direction of the liquid flow is shown by arrows. In particular, as best seen in FIG. 5, the liquid flows into the receptacle 110 through the open top 116, passes through the receptacle 110, and exits the receptacle 110 through the outlet openings 118. As the liquid passes through the receptacle 110, the liquid dissolves the packaging employed to contain the treating chemistry in the pod form and forms a mixture with the treating chemistry held within the pod. Some of the treating chemistry may dissolve into solution with the liquid, while some of the treating chemistry may not dissolve but rather be transported with the liquid through the outlet openings 118 in the same form, e.g., powder, as in the pod.

Referring back to FIG. 4, the liquid and treating chemistry that exits the dispenser 100 continues to flow downward and into the treating chamber 22, where the treating chemistry may be dispersed among the laundry, mixed with additional liquid, and/or dissolved if necessary. The liquid supplied through the spray nozzle 56 may be supplied under a suitable amount of pressure to force the liquid and treating chemistry to flow along this general path indicated by arrows. In addition, the spray nozzle 56 may provide an amount of liquid not only sufficient to dispense the treating chemistry from the dispenser 100 on the bellows 40 but also to fill the treating chamber 22 as specified for the selected cycle of operation. The supplying of the liquid to the treating chamber 22 may occur simultaneously with the supplying of the liquid to the dispenser 100 such that at least a portion of the liquid supplied to the treating chamber essentially flows through the dispenser 100 for the dispensing of the treating chemistry with the supply of liquid to the treating chamber 22.

The drum 20 may optionally rotate during the supplying of liquid to the dispenser 100. As the liquid and treating chemistry flow from the dispenser 100 into the treating chamber 22, rotating the drum 20 may facilitate dispersion of the treating chemistry amongst the items in the laundry. The drum 20 may rotate at any suitable speed(s), including a tumbling speed below which the laundry satellizes in the drum 20, in one direction, in reversing directions, intermittently, and/or continuously.

Figure 6:
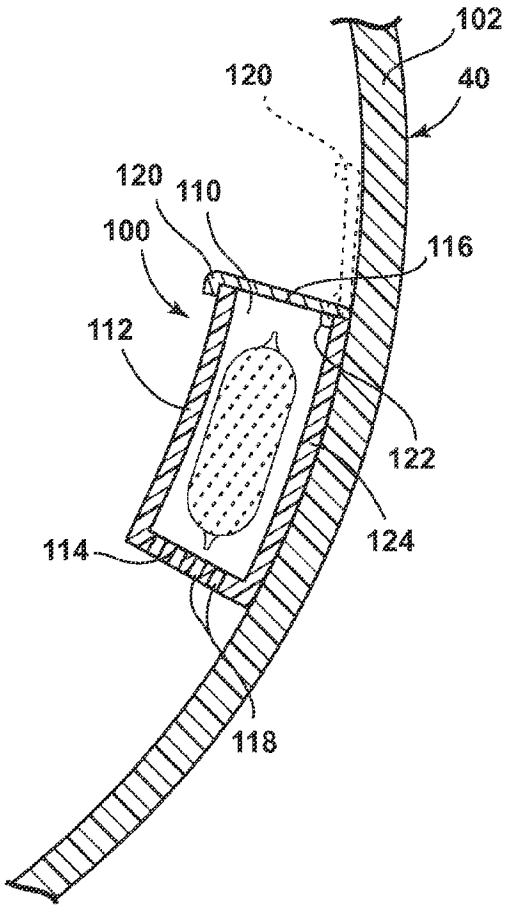
FIG. 6 is a schematic sectional view similar to FIG. 5 of an alternative treating chemistry dispenser according to another embodiment.

Various modifications may be made to the dispenser 100 and its method of use. For example, the dispenser 100 may include a lid 120, shown in the alternative embodiment of FIG. 6, to selectively close the open top 116 of the dispenser 100. The lid 120 may be movable, for example, about a hinge connection 122 from a closed position in the direction of the arrow to an open position shown in phantom, and vice-versa. The dispenser 100 may include a rear wall 124, if needed, separate from the bellows 40 (as compared to the bellows 40 forming the rear wall) to support the hinge connection 122. In one embodiment, the lid 120 may be configured for movement in response to an actuator that is automatically actuated, such as by the controller 88, at a desired time during the cycle of operation. Such a configuration is useful in operation cycles during which liquid is initially supplied to the treating chamber 22 during a pre-wash or pre-soak step that does not employ the treating chemistry. To this end, the lid 120 would remain closed during such a step when the treating chemistry is not required and subsequently opened when dispensing of the treating chemistry from the dispenser is desired so that the liquid may enter the dispenser receptacle 110 through the open top 116. The lid 120 may also be configured for manual opening and closing to allow user access to the receptacle 110, such as for loading the treating chemistry into the receptacle. Further, the lid 120 may be movable in manners other than pivoting, such as sliding movement.

Figure 7:
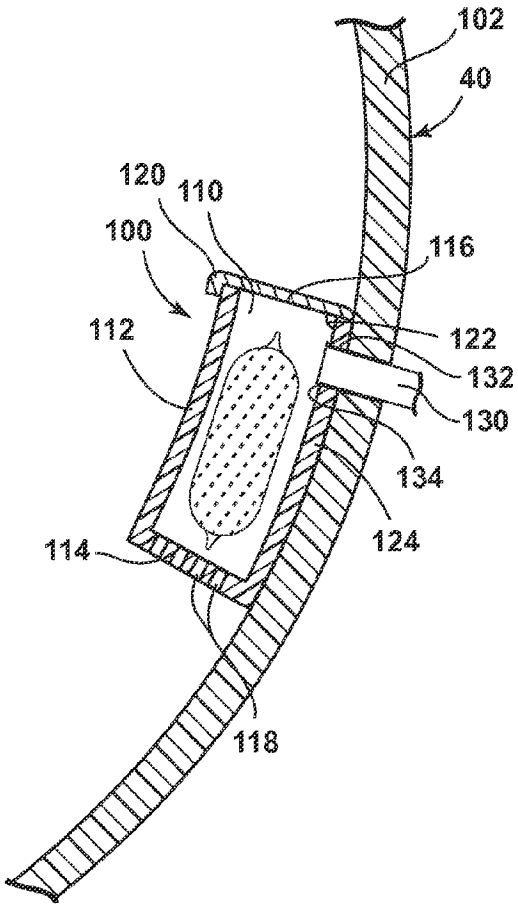
FIG. 7 is a schematic sectional view similar to FIG. 5 of an alternative treating chemistry dispenser according to another embodiment.

In another alternative embodiment, shown in FIG. 7, the dispenser 100 may be configured with its own dedicated liquid supply. The liquid supply for the dispenser 100 may be positioned to provide liquid directly into the receptacle 110, such as a position directly adjacent the dispenser 100, rather than the liquid flowing through the receptacle from a source spaced from the receptacle 110 during the supplying of liquid to the treating chamber 22. This configuration enables separate supply of liquid to the dispenser 100 and to the treating chamber 22, if desired.

As an example, the dedicated liquid supply may be in the form of a dispenser supply conduit 130, shown in FIG. 7, that passes through the bellows 40, such as through the portion of the bellows 40 that forms a rear wall for the receptacle 110, and terminates in the receptacle 110 to supply liquid directly into the receptacle 110. If the dispenser 100 includes the separate rear wall 124, then the dispenser supply conduit 130 may also extend through an inlet opening 132 on the rear wall 124. Regardless of the particular configuration, the dispenser supply conduit 130 may be provided with an optional spray nozzle 134 that sprays the liquid into the receptacle 110 in a desired manner. The dispenser 100 may also include the lid 120 to contain the liquid provided by the dispenser supply conduit 130 within the receptacle 110 for use in dissolving the pod packaging and/or the treating chemistry held within the packaging. The lid 120 may be movable between opened and closed positions, as described in the previous embodiment, to facilitate user access to the interior of the receptacle 110 for loading the dispenser 100 with the treating chemistry.

Figure 8:
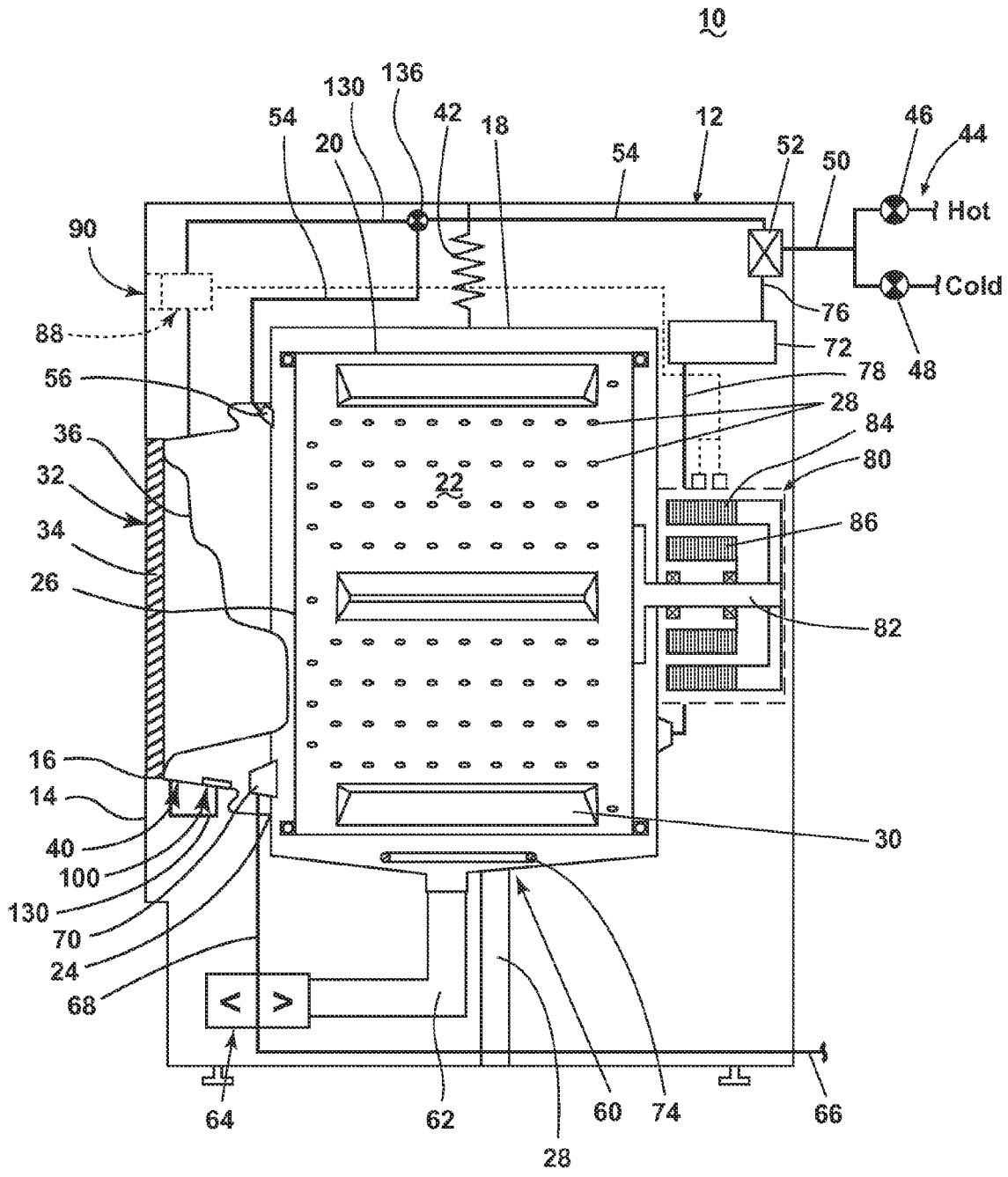
FIG. 8 is a schematic view of a washing machine similar to FIG. 1 with a liquid supply system adapted for the treating chemistry dispenser of FIG. 7 according to one embodiment.

Referring to the schematic diagram of the washing machine 10 in FIG. 8, the dispenser supply conduit 130 may be fluidly coupled to the supply conduit 54, such as by a valve 136 or other diverter mechanism, for receiving liquid from the household water supply 44. The valve 136 may be operably coupled to the controller 88 such that the controller 88 may control the valve 136 as needed to provide liquid to the dispenser supply conduit 130 when the dispensing of the treating chemistry is needed during the cycle of operation. The valve 136 may optionally be configured to provide liquid selectively to the spray nozzle 56 or the dispenser supply conduit 130 or to both the spray nozzle 56 and the dispenser supply conduit 130 simultaneously, depending on whether the cycle of operation calls for filling the treating chamber 22, dispensing the treating chemistry, or both. As mentioned above, providing the dispenser 100 with its own dedicated liquid supply allows the washing machine 10 to supply the liquid to the treating chamber 22 through the spray nozzle 56 separately from supplying the treating chemistry to the treating chamber 22 through the dispenser supply conduit 130, if desired.

The dispenser supply conduit 130 may alternatively be located in other positions adjacent to the dispenser 100. For example, the dispenser supply conduit 130 may be external to the receptacle 110, such as in a position directly above the open top 116 for supplying liquid into the receptacle 110 through the open top 116. In this example, the dispenser 100 may or may not have the lid 120 and may or may not be positioned in the flow path of liquid supplied to the treating chamber 22 from the spray nozzle 56.

Figure 9:
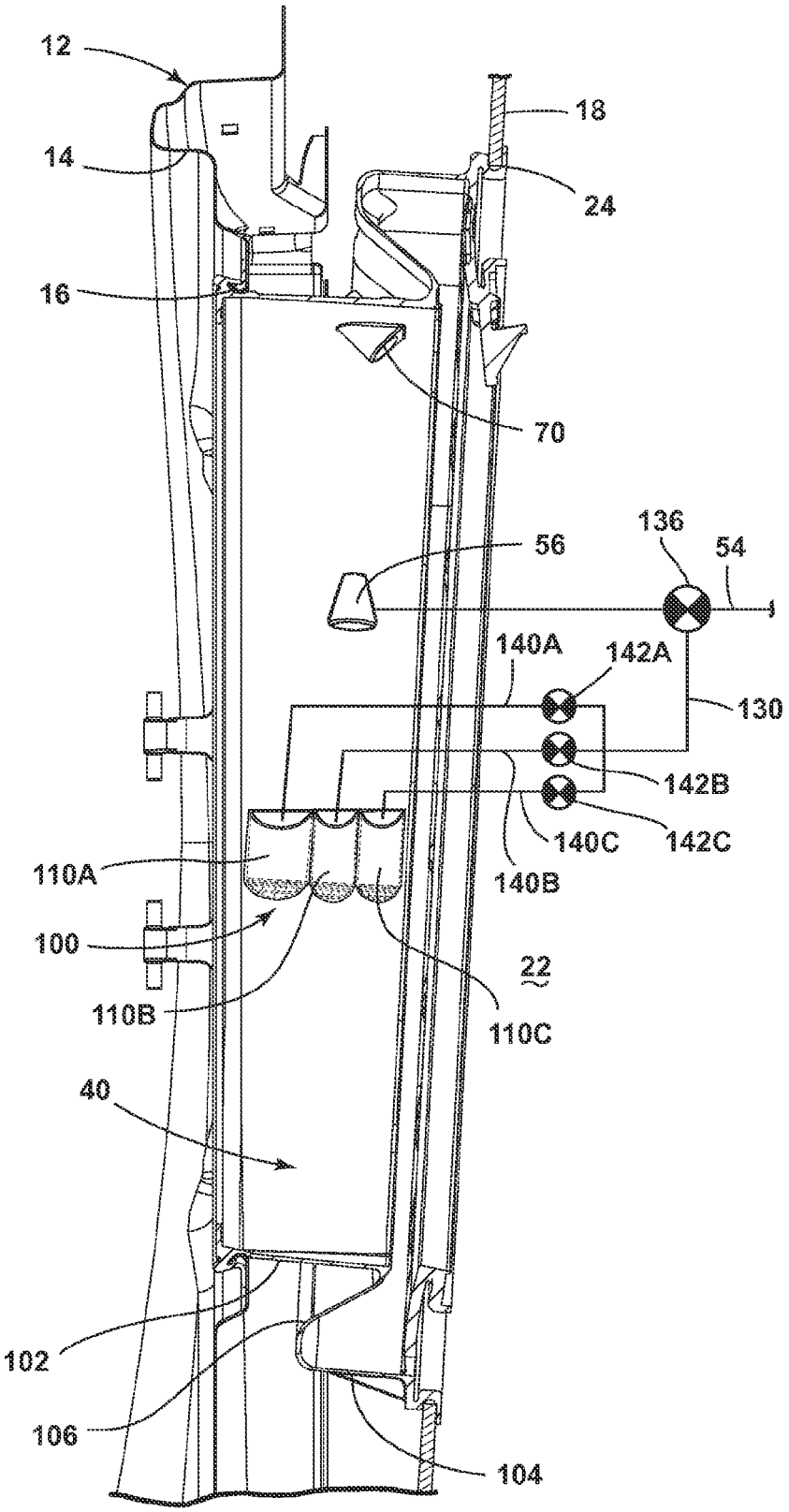
FIG. 9 is a sectional view similar to FIG. 4 showing another alternative treating chemistry dispenser and including a schematic diagram of a liquid supply system for use with the alternative treating chemistry dispenser according to one embodiment.

As another alternative, the dispenser 100 may be configured to include multiple receptacles 110, which is schematically illustrated in FIG. 9. The exemplary alternative dispenser 100 includes three receptacles 110A, 110B, 110C, with it being understood that the dispenser 100 may include any number of receptacles. The receptacles 110A, 110B, 110C may be of differing sizes, the same size, or a combination thereof. For example, the receptacle 110A may be larger than the receptacles 110B, 110C, which may be the same size. Each receptacle may hold a separate treating chemistry, which may be dispensed separately or simultaneously.

In the illustrated embodiment, the receptacles 110A, 110B, 110C may have their own receptacle supply conduit 140A, 140B, 140C fluidly coupled to the dispenser supply conduit 130. Liquid flow to each of the receptacles 110A, 110B, 110C may be controlled by a valve 142A, 142B, 142C or other liquid flow control device operably coupled to the controller 88. In one example, the valves 136, 142A, 142B, 142C may be controlled so that liquid may be supplied to the first receptacle 110A, such as during one step, for example a wash step, of the cycle of operation, and subsequently to one or both of the second and third receptacles 110B, 110C, such as during another step, for example a rinse step, of the cycle of operation. In another example, the valves 136, 142A, 142B, 142C may be controlled to provide liquid to all three receptacles 110A, 110B, 110C for dispensing the treating chemistries simultaneously. The valves 136, 142A, 142B, 142C may have any other suitable arrangement are not limited to that shown in FIG. 9, and the valves 136, 142A, 142B, 142C may be replaced with other liquid flow control devices as appropriate. Alternatively, in a simpler configuration, the receptacles 110A, 110B, 110C may dispense the treating chemistries when liquid supplied to the treating chamber 22 passes therethrough, as in the embodiments of FIGS. 4-6, rather than having their own dedicated liquid supply. Regardless of the manner in which liquid is supplied to the receptacles, the receptacles 110A, 110B, 110C may optionally include corresponding lids, which may be independently or cooperatively movable, to prevent undesired liquid flow into and/or out of the receptacles 110A, 110B, 110C through the open top 116.

As mentioned earlier, the dispenser 100 may be made integral with the bellows 40 or may be a separate structure mounted to the bellows 40. Further, the dispenser may be made of the same material as the bellows 40 or a different material. It is further contemplated that the dispenser 100, or at least a portion of the dispenser 100, may be of a color that is different than the bellows 40 so as to visually distinguish the dispenser 100 from the bellows 40.

The dispensing system for the washing machine 10 may have the dispenser 100 on the bellows 40 as the sole treating chemistry dispenser or may include other, additional treating chemistry dispensers. For example, the dispenser 100 on the bellows 40 may be a designed dispenser for use with treating chemistry in the form of a pod, while another dispenser, such as a drawer-type dispenser, may be for use with treating chemistry in other forms, such as liquids, gels, and/or loose powders. The washing machine 10 may optionally include a selection switch on the user interface 90 that allows a user to communicate the type of treating chemistry and/or a selected treating chemistry dispenser, and the controller 88 may adapt a cycle of operation, such as the manner in which the controller 88 controls the liquid supply system, based on the selection.

For all embodiments, locating the dispenser 100 on the bellows 40 helps to prevent the pod, or other form of treating chemistry, from being lodged in the bellows 40, which has been known to occur in prior washing machines. The inventive dispenser 100 is strategically positioned and configured for dispensing the treating chemistry from the bellows 40 into the treating chamber 22. The liquid supply to the dispenser 100, whether from a supply outlet spaced from the dispenser 100 or an outlet directly adjacent the dispenser 100, such as extending into the receptacle 110, may flush the treating chemistry out of the bellows 40 and into the treating chamber 22. Additionally, when the treating chemistry is in the form of a pod, the packaging must dissolve within the dispenser 100 before the treating chemistry is released; it is not possible for an undissolved pod to become lodged or otherwise located in a position within the washing machine where it will not completely dissolve.

While the invention has been specifically described in connection with certain specific embodiments thereof, it is to be understood that this is by way of illustration and not of limitation, and the scope of the appended claims should be construed as broadly as the prior art will permit.

What is claimed is:

1. A laundry treating appliance for treating laundry according to an automatic cycle of operation, the appliance comprising:

a chassis having a front panel with an opening;

a tub located within the chassis and at least partially defining a treating chamber, the tub having an opening at least partially aligned with the front panel opening providing access to the treating chamber through the front panel opening and the tub opening;

a bellows connecting the front panel and the tub at their respective openings;

a treating chemistry dispenser located on the bellows and including a receptacle holding a treating chemistry; and a liquid supply system including a liquid conduit with an outlet positioned to supply liquid into the receptacle whereby the liquid from the liquid conduit flows through the receptacle dispensing the treating chemistry from the receptacle into the treating chamber.

2. The appliance of claim 1 wherein the dispenser is mounted to the bellows.

3. The appliance of claim 1 wherein the dispenser is integrally formed with the bellows.

4. The appliance of claim 1 wherein the dispenser is of a color different than the bellows so as to visually distinguish the dispenser from the bellows.

5. The appliance of claim 1 wherein the receptacle has an open top, and the outlet is positioned to supply the liquid through the open top into the receptacle.

6. The appliance of claim 1 wherein the receptacle has an open top and a lid selectively closing the open top of the receptacle.

7. The appliance of claim 1 wherein the dispenser comprises multiple of the treating chemistry receptacles, each receiving a corresponding treating chemistry.

8. The appliance of claim 1 wherein the bellows has a generally circular shape, and the receptacle is located on a lower half of the bellows.

9. The appliance of claim 1 wherein the receptacle includes a bottom wall with an outlet opening fluidly communicating the receptacle with the treating chamber, wherein the treating chemistry rests on the bottom wall and is supplied to the treating chamber through outlet opening.

10. The appliance of claim 1 wherein the outlet is located on the bellows and is spaced from the receptacle.

11. The appliance of claim 1 wherein the outlet is adjacent to the receptacle.

12. The appliance of claim 11 wherein the receptacle includes a wall, and the outlet is positioned to supply liquid into the receptacle through the wall.

13. The appliance of claim 12 wherein the bellows forms the receptacle wall.

* * * * *